US008388188B2

(12) United States Patent
Propp

(10) Patent No.: US 8,388,188 B2
(45) Date of Patent: Mar. 5, 2013

(54) LIGHT EMITTING DIODE ORNAMENTAL DISPLAY ILLUMINATION SYSTEM WITH REMOTE SOLAR CELL

(76) Inventor: Nancy A. Propp, New York, NY (US)

( * ) Notice: Subject to any disclaimer, the term of this patent is extended or adjusted under 35 U.S.C. 154(b) by 23 days.

(21) Appl. No.: 12/807,783

(22) Filed: Sep. 14, 2010

(65) Prior Publication Data

US 2012/0063159 A1 Mar. 15, 2012

(51) Int. Cl.
*F21V 19/02* (2006.01)

(52) U.S. Cl. ..... 362/285; 362/220; 362/418; 362/554; 362/565; 362/806

(58) Field of Classification Search ..... 362/220, 362/253, 285, 287, 418, 551, 554, 555, 557, 362/565, 806
See application file for complete search history.

(56) References Cited

U.S. PATENT DOCUMENTS

| | | | | |
|---|---|---|---|---|
| D485,389 | S | 1/2004 | Weiser et al. | |
| 7,249,863 | B2 | 7/2007 | Ballarini et al. | |
| 7,429,827 | B2 | 9/2008 | Richmond | |
| 2007/0206393 | A1 | 9/2007 | Soon | |
| 2008/0273348 | A1 * | 11/2008 | Klohn et al. | 362/567 |

* cited by examiner

*Primary Examiner* — Meghan Dunwiddie
(74) *Attorney, Agent, or Firm* — William Propp, Esq.

(57) ABSTRACT

An illumination system has a light emitting diode (LED) illuminated ornamental display. The ornamental display is removably attached to the LED. A solar cell and rechargeable battery are remotely connected to the LED ornamental display by a bendable electrically conductive wire. The bendable electrically conductive wire electrically connects the battery to the LED and physically supports the LED ornamental display.

19 Claims, 21 Drawing Sheets

LIGHT EMITTING DIODE ORNAMENTAL DISPLAY ILLUMINATION SYSTEM WITH REMOTE SOLAR CELL

BACKGROUND OF THE INVENTION

This invention relates generally to a light emitting diode (LED) ornamental display that can be mounted in a yard, on a balcony or porch, or indoors, and, more particularly, this invention is directed to a light emitting diode (LED) that is removably attached to an ornamental display, with a remote solar cell power source, and a bendable electrically conductive wire to supply power from the solar cell to the LED and to support the ornamental display.

It is known that light bulbs and light emitting diodes can emit light for an illumination system. It also known that solar cells are a power source for outdoor illumination systems.

A dragonfly light on a stake is shown in Design Pat. D485,389. The design patent only covers the outside appearance of the dragonfly light. The light source is a light bulb. The design patent does not specify a LED light source or a solar cell power source. The dragonfly light is on a stake which limits its use to outdoors, near the ground, and with a fixed viewing angle.

An outdoor garden light has three different colored LEDs mounted in a cap assembly at the top of a spike in U.S. Pat. No. 7,429,827. A solar cell and rechargeable battery on top of the cap assembly power the LEDs inside. The outdoor garden light does not have an ornamental display. And again being on a stake prevents the garden light from being used in a tree or bush outdoors, being used on a balcony or a porch, or being used indoors.

A solar cell star on top of an outdoor Christmas tree provides the power for the Christmas tree lights decorating the tree in U.S. Pat. No. 7,249,863. The solar cell on the Christmas tree does not have an ornamental display illuminated by a LED and does not allow for detachment and replacement of the ornamental display from a LED.

Decorative fixtures, such as flowers and butterflies, can be attached and detached to light emitting diodes on a base in US Published Patent Application 20070206393. A solar cell on the base recharges the batteries in the base. The batteries inside the base provide electricity to a series of plugs on the surface of the base. Each LED has an electrical wire stem which is inserted into a plug. Each LED illuminates one decorative head.

The prior art invention has three separate elements: a decorative head, a stem and a base, which must be combined to form the illumination system. The prior art invention requires a base. The prior art invention is not freestanding. The prior art invention is limited in location to a flat surface like a desk or table top or the ground. The prior art invention is primarily limited to indoor use and more specifically to indoor use directly adjacent to a window to power the solar cell.

Nowhere in the prior art is there an illumination system powered by a solar cell with a LED ornamental display which can be used outdoors on a tree branch, in a bush, or on the ground, on a fence or railing of a balcony or porch, or indoors.

The prior art shows a solar cell adjacent to the light display. Therefore, the light display must be in the sunlight like the solar cell and in close proximity to the solar cell. The prior art devices do not show a remote solar cell at a distance from the LED ornamental display so the solar cell can be in sunlight while the display is in darkness or at a different height or position from the solar cell.

The prior art devices need a stake or a base, but do not show any other way to support the LED ornamental display.

The prior art does not show a detachable, removable, attachable means to change ornamental displays for the same LED or to change LEDs for the same ornamental display.

It is an object of this invention to provide an illumination system where the light emitting diode ornamental display is remote, at a distance, from the solar cell.

It is another object of this invention to provide an illumination system where the ornamental display is removably attached to the light emitting diode light source.

It is still another object of this invention to provide a light emitting diode ornamental display illumination system where a bendable electrically conductive wire supplies power from the solar cell to the light emitting diode light source and supports the ornamental display.

It is a further object of this invention to provide an illumination system, without a ground stake or base, which is positioned in tree or bush branches, on the ground, on railings and fences, and coiled up on windowsills and table legs and tables. The illumination system can be used on patios and in flower pots and planters. The illumination system can be interwoven in chair backs, both indoors and outdoors, and in outdoor chain link fences.

It is still a further object of this invention to provide an illumination system which operates outdoors, on porches and balconies, and indoors.

SUMMARY OF THE INVENTION

According to the present invention, an illumination system has a light emitting diode (LED) illuminated ornamental display, a solar cell and rechargeable battery power source, and a bendable electrically conductive wire which electrically connects the battery to the LED and physically supports the LED ornamental display.

The light emitting diode is removably attached to the ornamental display. The light emitting diode may be one or multiple LEDs. The multiple LEDs can each emit light of different colors. A LED control circuit controls the frequency and intensity of the light emitted by at least one LED.

The ornamental display can be in the shape of a butterfly or flower or any other decorative shape or design.

The display can be formed from plastic, polymer, resin, aluminum or glass. Light from the LED transmitted through such materials will illuminate and glow the ornamental display.

The display can be formed from a sheet of optical fibers. Light from the LED transmitted through the optical fibers will illuminate points of light on the ornamental display.

The bendable electrically conductive wire can wrap around a branch, railing or fence or grip the branch, railing or fence.

The LED illuminated ornamental display illumination system can be positioned on a balcony or porch or positioned indoors.

The solar cell and rechargeable battery can be remote, or at a distance, from the LED ornamental display.

An on/off switch or a light sensor can turn the LED illuminated ornamental display on and off at night.

The LED illuminated ornamental display illumination system can be freestanding. The bendable electrically conductive wire can, by itself, be a freestanding base and support for the ornamental display The ornamental display can be formed of aluminum or metal. The ornamental display can be reflective, rather than transmissive. The LED is on the upper surface of the display. Light emitted by the LED will be reflected by the metal surface of the ornamental display.

The ornamental display can be a plurality of loose optical fibers secured at only one end adjacent to the light emitting diode but transmitting points of light from the other end.

Other aspects of the invention will become apparent from the following more detailed description, taken in conjunction with the accompanying drawings.

BRIEF DESCRIPTION OF THE DRAWINGS

The preferred embodiments of this invention will be described in detail, with reference to the following figures wherein.

DETAILED DESCRIPTION OF THE INVENTION

Figure 1:
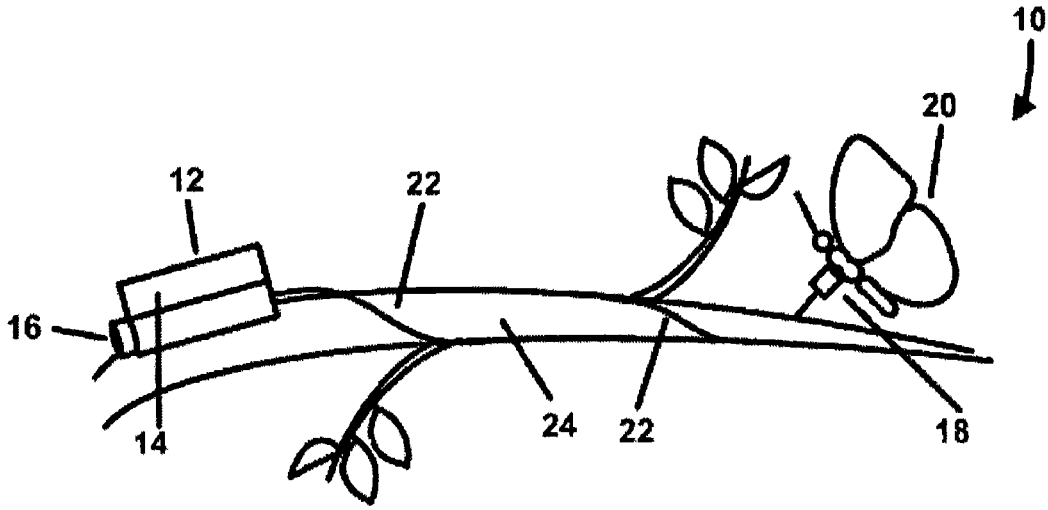
FIG. 1 is a side view of a light emitting diode (LED) illuminated ornamental display illumination system of the present invention.

The following elements described in the specification with their numbering in the drawings are in the invention of the present application.

10—Light emitting diode ornamental display illumination system
12—Solar Cell
14—Rechargeable Battery
16—On/Off Switch
18—LED
20—Ornamental Display
22—Bendable Electrically Conductive Wire
24—Other Object
26—Sunlight
28—Housing
30—Upper Side of the Housing
32—Bottom Side of the Housing
34—Covered Opening on the Bottom Surface
36—Wire between the Solar Cell and the Rechargeable Battery
38—Wire between the Rechargeable Battery and the On/Off Switch
40—Wire between the On/Off Switch and the Bendable electrically conductive wire
42—Bottom Surface of the Ornamental Display
44—Top or Upper Surface of the Ornamental Display
46—LED Control Circuit
48—Glowing Ornamental Display
50—Points of Light
52—Optical Fibers in the Ornamental Display
54—End of Optical Fibers
56—Screw Fitting
58—Reciprocal Screw Fitting
60—Velcro or Strap
100—Other Object that Wire can be Attached to
102—One Side of Object
104—Opposite Side of Object
106—U Shaped Grip
108—Opposing U Shaped Grip
200—Copper or Other Metal Conduit
202—Protective Insulated Sheath of Plastic/Rubber
204—Casing
206—Support Wire
300—Stake or Pole
302—Ground
400—Chain link fence
402—Chain links
500—Base and Support
600—Light emitting diode (LED) illuminated ornamental display illumination system with two ornamental displays
602—Solar Cell Power Source
604—First light emitting diode (LED) illuminated ornamental display
606—Second light emitting diode (LED) illuminated ornamental display
608—Solar cell
610—Rechargeable battery
612—On/off switch
614—First light emitting diode (LED)
616—First ornamental display
618—First bendable electrical wire
620—Second light emitting diode (LED)

622—Second ornamental display
624—Second bendable electrically conductive wire
626—First light emitting diode control circuit
628—Second light emitting diode control circuit
700—Light emitting diode ornamental display illumination system with reflective ornamental display
702—Reflective ornamental display
704—Light emitting diode (LED)
706—Bottom Surface of the Ornamental Display
708—Top or Upper Surface of the Ornamental Display
710—Light emitting diode control circuit
800—Light emitting diode ornamental display illumination system with loose optical fibers ornamental display
802—Optical fibers ornamental display
804—Light emitting diode
806—Optical fiber
808—First end of optical fiber
810—Second end of optical fiber
900—Power source of a Solar Cell and Battery
902—Wire between the Solar Cell and the Switch
904—Switch
906—Wire between the Switch and the Battery
908—Battery Reference is now made to FIG. 1 illustrating a light emitting diode ornamental display illumination system 10 having a solar cell 12, a rechargeable battery 14 adjacent to the solar cell 12, an on/off switch 16 adjacent to the rechargeable battery 14, a light emitting diode (LED) 18, an ornamental display 20 which is removably attachable to the LED 18, and a bendable electrically conductive wire 22 which electrically connects the battery 14 to the LED 18 and supports the ornamental display 20. The solar cell is remote, or at a distance, from the LED and ornamental display.

The solar cell 12 charges the rechargeable battery 14. The bendable electrical wire 22 supplies electrical power from the battery 14 to the LED 18. The LED 18 will illuminate the ornamental display 20 from within the ornamental display 20 for viewing from outside the display 20. The bendable electrical wire 22 also can be removably attached to a tree branch 24 or a bush branch or a fence or a railing or other object to physically support the display 20. The bendable electrically conductive wire 22 is wrapped around the tree branch 24 in this Figure.

Figure 2:
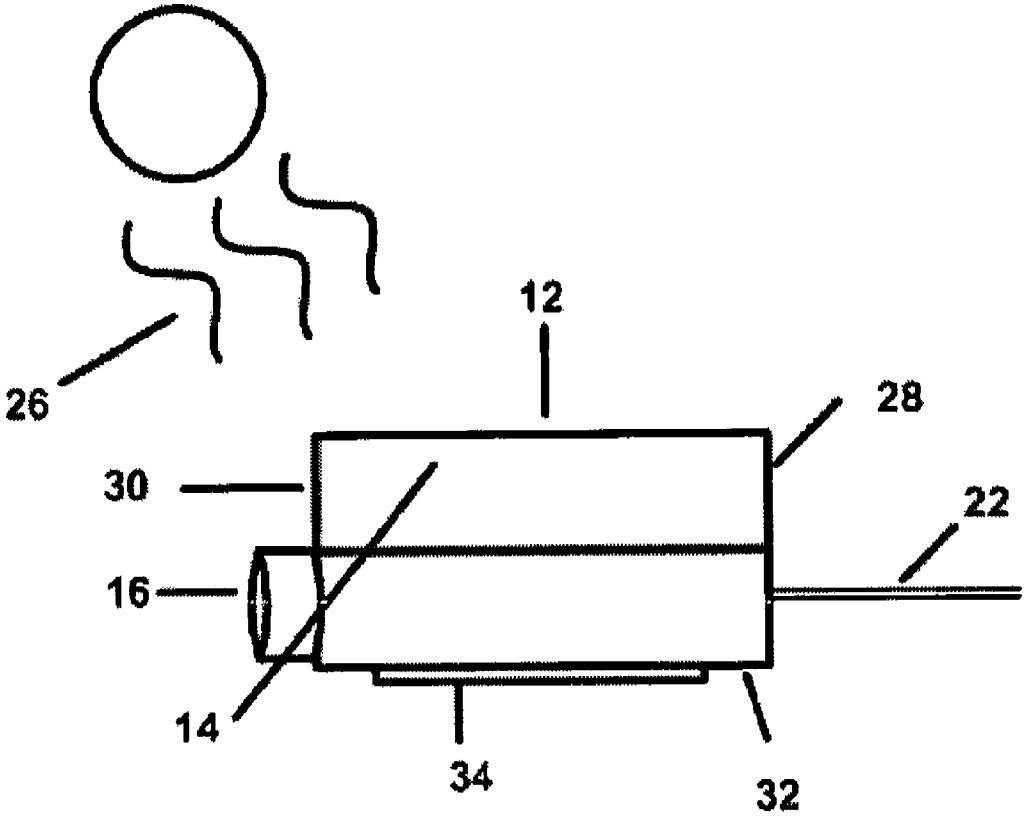
FIG. 2 is a side view of the power source of a solar cell and rechargeable battery for the illumination system of FIG. 1.
Figure 3:
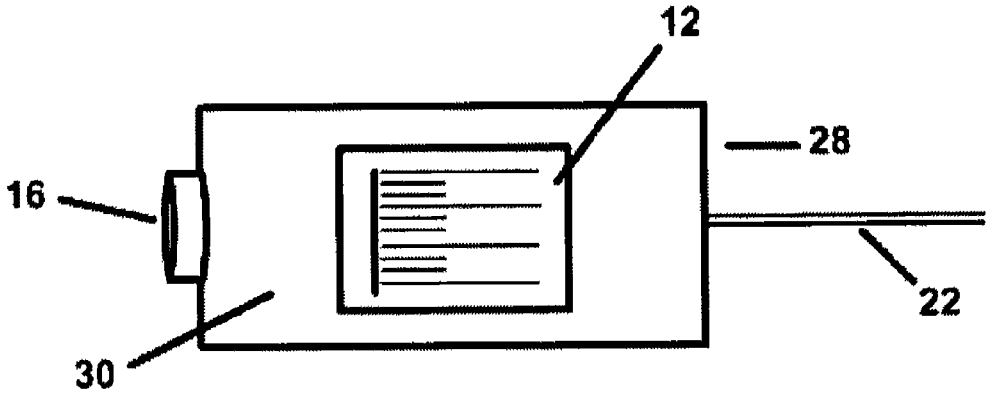
FIG. 3 is a top view of the power source of a solar cell and rechargeable battery for the illumination system of FIG. 1.
Figure 4:
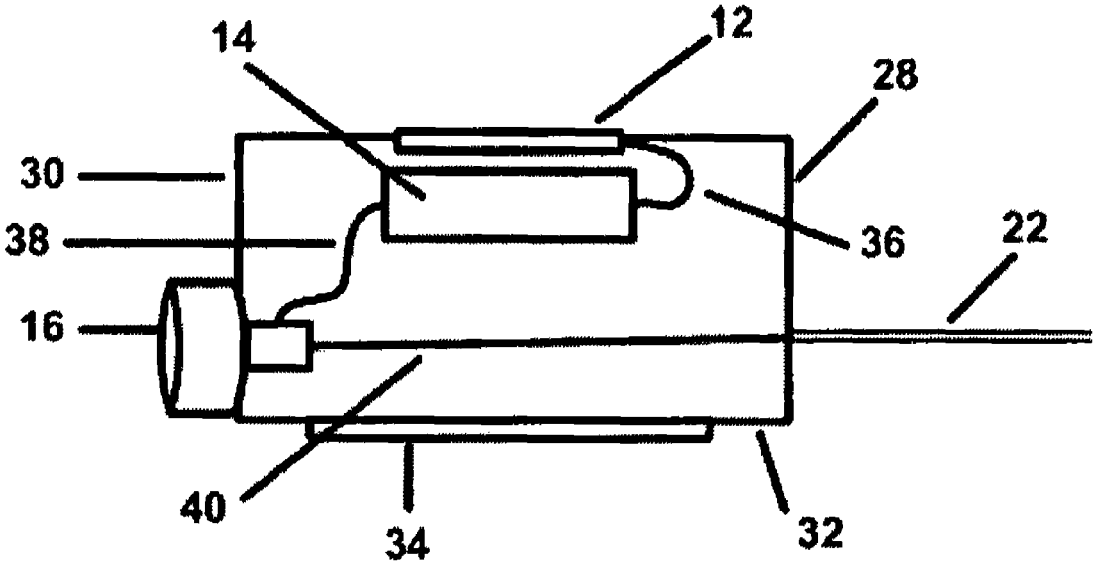
FIG. 4 is a side view of the power source of a solar cell and rechargeable battery for the illumination system of FIG. 1.

The on/off switch 16 is in the electrical circuit between the battery 14 and the LED 18. The switch will turn the LED on and off, if the rechargeable battery is charged. The LED will also be turned off, without any action by the switch, when the rechargeable battery is drained. The power source for the LED ornamental display in the illumination system is a solar cell 12 and a rechargeable battery 14 with an on/off switch 16 as shown in FIGS. 2, 3 and 4.

Sunlight 26, either directly or indirectly, is incident on the solar cell 12. The solar cell is positioned to be in the direct sunlight for an extended period of time.

The solar cell is a semiconductor device which converts sunlight into electricity which is then stored by the rechargeable battery. The rechargeable battery 14 may be a nickel-cadmium (Ni-Cad), nickel metal hydride (NiMH), lithium ion, lead-acid, or other suitable battery.

The solar cell 12 and rechargeable battery 14 are contained within a housing 28 on opposite sides of the housing. The solar cell will be on the upper side 30 of the housing towards the sunlight while the battery will be on the bottom side 32 of the housing.

The housing 28 will be rubber, plastic or polymer and will be sealed to protect the solar cell and rechargeable battery power source from heat, cold, water, dust, insects, animals and other harmful elements in the environment, whether outdoors, on a porch or balcony, or indoors. The housing will be electrically insulating or non-conductive.

The housing 28 may have a covered opening 34 in the bottom surface 32 so the rechargeable battery or batteries can be replaceable.

As best seen in the power source of a solar cell and rechargeable battery of FIG. 4, a wire 36 electrically connects the solar cell 12 to the rechargeable battery 14 so that the electricity generated by the solar cell will recharge the battery. A wire 38 electrically connects the battery to the on/off switch 16 and a wire 40 electrically connects the on/off switch to the external bendable electrically conductive wire 22. The wires 38 and 40 and on/off switch 16 will supply power from the battery to the LED in the ornamental display for the illumination system of FIG. 1.

Figure 5:
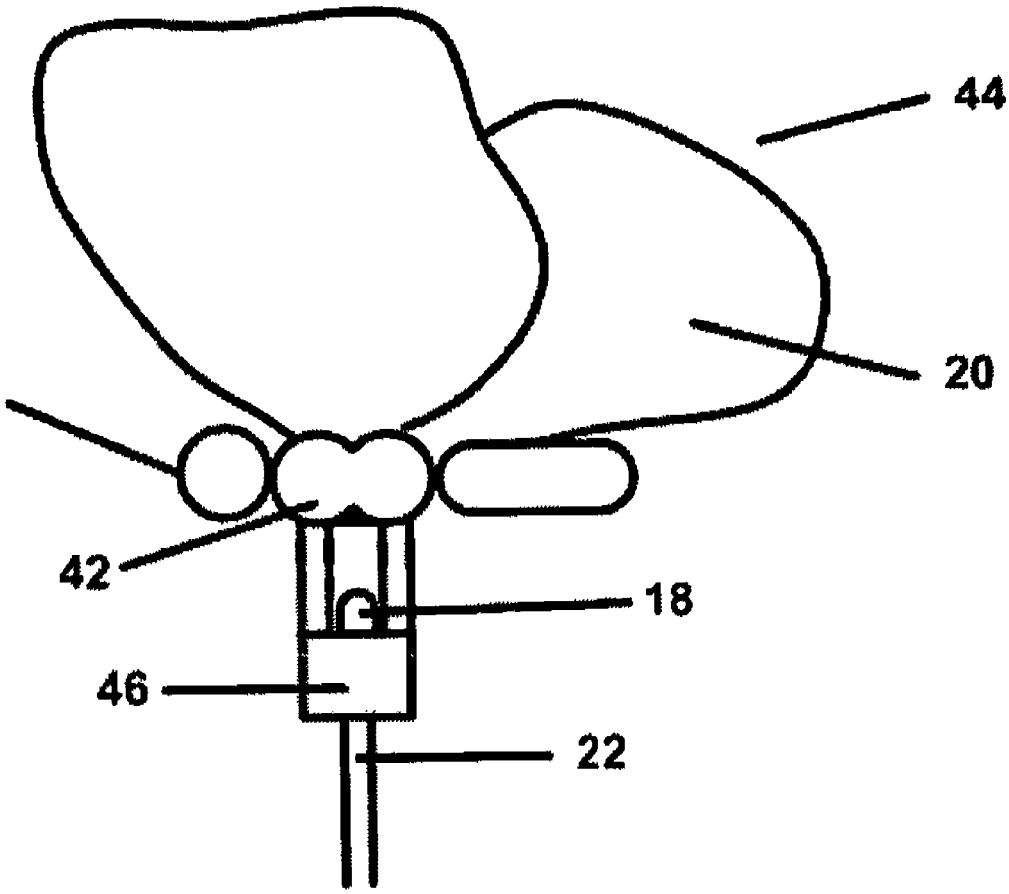
FIG. 5 is a side view of the LED light source and ornamental display for the illumination system of FIG. 1.

The light source for the ornamental display 20 in the illumination system is at least one light emitting diode 18, as seen in FIG. 5.

The light source 18 is removably attached to the bottom surface 42 of the ornamental display 20. Light emitted by the LED will be transmitted through the ornamental display and then transmitted out of the top or outer surface 44 of the display to be viewed by the viewer. The transmitted light will illuminate the ornamental display by causing the display to glow or by causing the display to have points of light or some combination thereof.

The light emitting diode can emit light of a single color such as white, red, blue, green or another color. The light emitting diode can be multiple light emitting diodes emitting light of one color, or two or more colors.

A light emitting diode control circuit 46 is adjacent to the light emitting diode 18. The LED control circuit is in the electrical circuit between the battery and the LED. The LED control circuit will control the frequency and intensity of the light emitted from the LED which illuminates the ornamental display 20. In the case of a single LED illuminating the ornamental display, the LED control circuit will just control the frequency of the light emission and the varying intensity of the light emission. The LED under the control of the control circuit can emit a steady light, a steady light that varies in intensity, a blinking light, or a blinking light that varies in intensity.

In the case of multiple LEDs, the illumination light source will typically have two light emitting diodes, each light emitting diode emitting light of a different color, or three light emitting diodes, each light emitting diode emitting light of a different color.

In the case of multiple LEDs illuminating the ornamental display, the LED control circuit 46 will control the frequency of the light emission and the varying intensity of the light emission and also allow for color shifting so that a first color fades into a second color. LED circuitry can fade the emitted light from one color to a different color causing the emitted light to change color when illuminating the ornamental display.

The LED control circuit 46 can control the frequency of the light emission and the varying intensity of the light emission and also allow for color mixing when light of a first color is mixed with light of a second color to form light of a third color illuminating the ornamental display.

The LED control circuit can alternately be positioned adjacent to the solar cell and battery.

Figure 6:
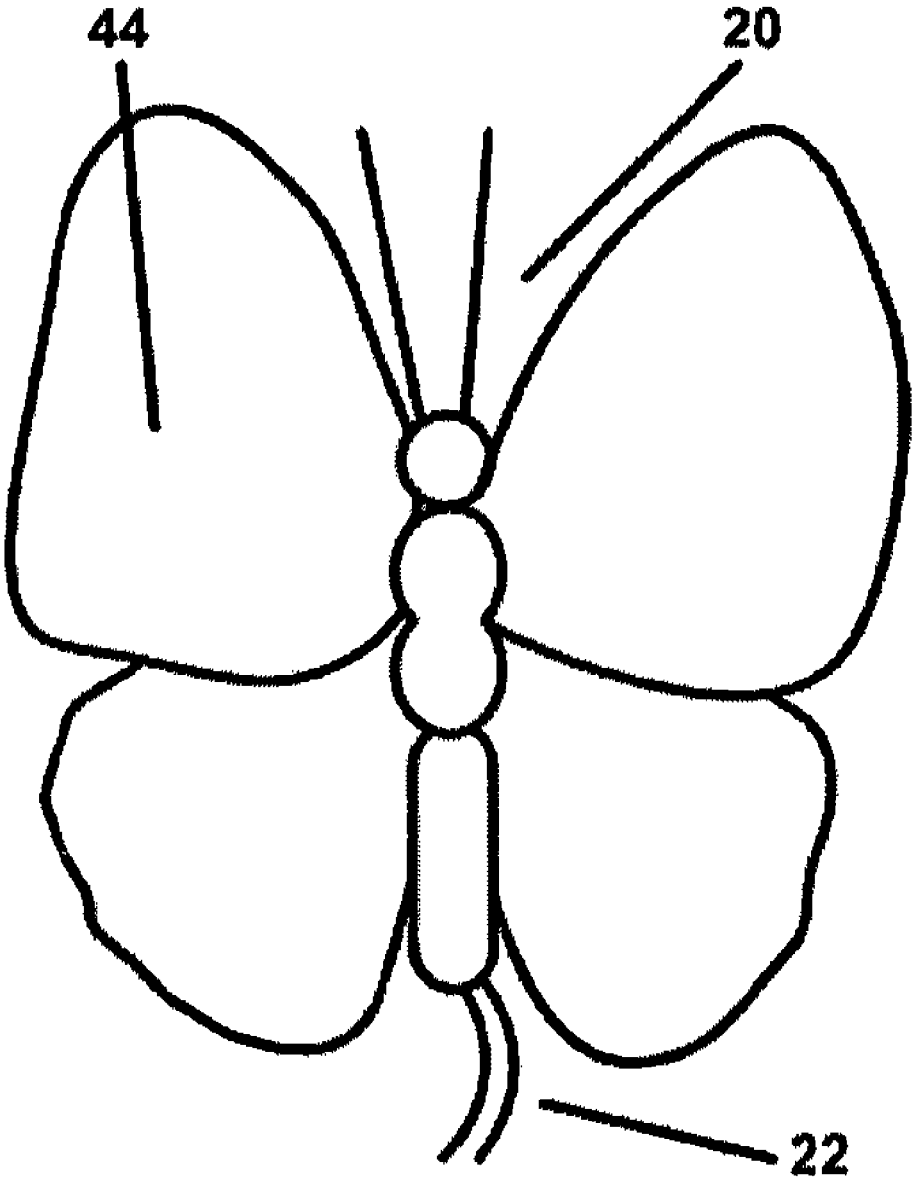
FIG. 6 is a top view of the LED light source and ornamental display for the illumination system of FIG. 5.

The ornamental display 20 of FIGS. 5 and 6 can be formed of plastic, polymer, resin, glass, optical fibers or any material that is transparent or translucent. The ornamental display can be solid or hollow and is typically formed by conventional molding processes.

An optical fiber ornamental display can be formed by folding a sheet of optical fibers. An optical fiber sheet is cut and folded into the ornamental display. The cuts and folds create more open ends to the optical fibers. Light is emitted by the LED at one end of the optical fibers in the sheet. The LED emitted light is transmitted through the optical fibers. The other end of the optical fibers in the sheet emit points of light which illuminate or glow for the ornamental display.

The ornamental display can be any shape. The display can be a butterfly as shown or other insect, any bird, any flower, any plant, any creature such as an angel or fairy, any artistic item such as a stained glass ball, or any geometric shape, such as a star, crescent moon, or snowflake.

Figure 7:
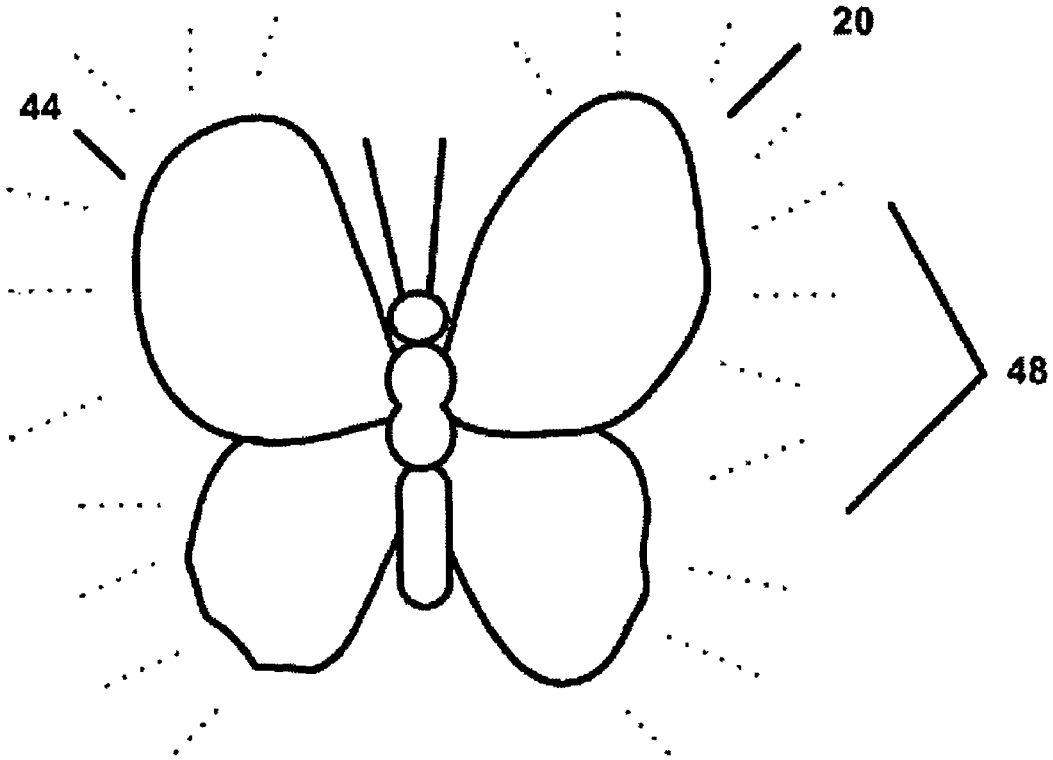
FIG. 7 is a top view of the illumination glow of the ornamental display for the illumination system of FIG. 1.

The light emitting diode 18 on the bottom surface 42 of the ornamental display 20 will emit light to illuminate the adjacent ornamental display. Light emitted by the LED will be transmitted through the ornamental display and then transmitted out of the top or outer surface 44 of the display to be viewed by the viewer. The transmitted light will illuminate the ornamental display by causing the display to glow 48 in FIG. 7 or by causing the display to have points of light 50 of FIG. 8 or some combination thereof. A plastic, polymer, resin, or glass ornamental display 20 in FIG. 7 will transmit light from the light emitting diode through the display to glow 48 along a wide area on the outer surface 44 of the display.

Figure 8:
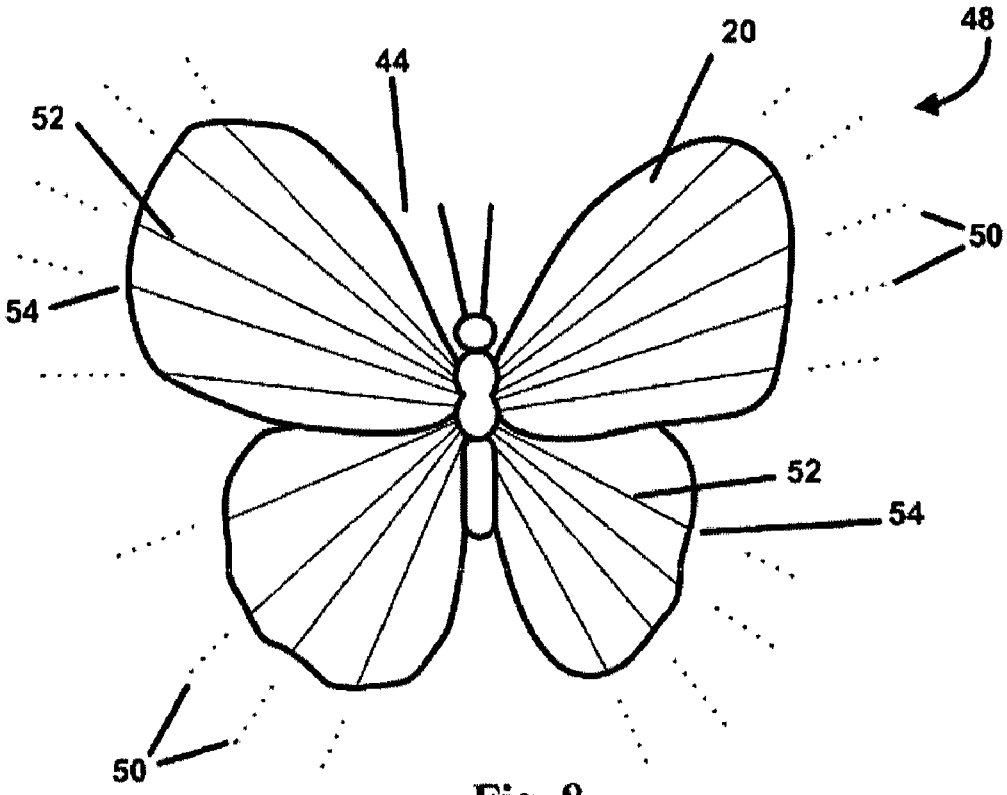
FIG. 8 is a top view of illumination points of light of the ornamental display for the illumination system of FIG. 1.

Optical fibers 52 in the ornamental display 20 in FIG. 8 will transmit light from the light emitting diode through the optical fibers 52 of the display to the ends 54 of the optical fibers to form points of light 50 on the outer surface 44 of the display.

The ornamental display material can be clear or hollow so the illuminated ornamental display is the same color as the light emitted by the light emitting diode.

The ornamental display can be clear with a painted outer or top surface so a white LED will illuminate and glow the ornamental display with the color of the outer surface paint. A colored LED will illuminate and glow the ornamental display with the color combination of the color LED and the color of the outer surface paint.

The ornamental display material can be tinted a color, such as red, orange, yellow, green, blue, violet or purple. A white LED will illuminate and glow the ornamental display with the color of the tint of the ornamental display material. A colored LED will illuminate and glow the ornamental display with the color combination of the color LED and the color of the tint of the ornamental display material. Portions of the ornamental display can be tinted different colors so the display will illuminate or glow different colors The light emitting diode is positioned inside the ornamental display or positioned adjacent to the bottom surface of the ornamental display. The light emitted by the LED will be transmitted through the ornamental display and will illuminate or glow the ornamental display for viewing the ornamental display from outside the display.

Figure 9:
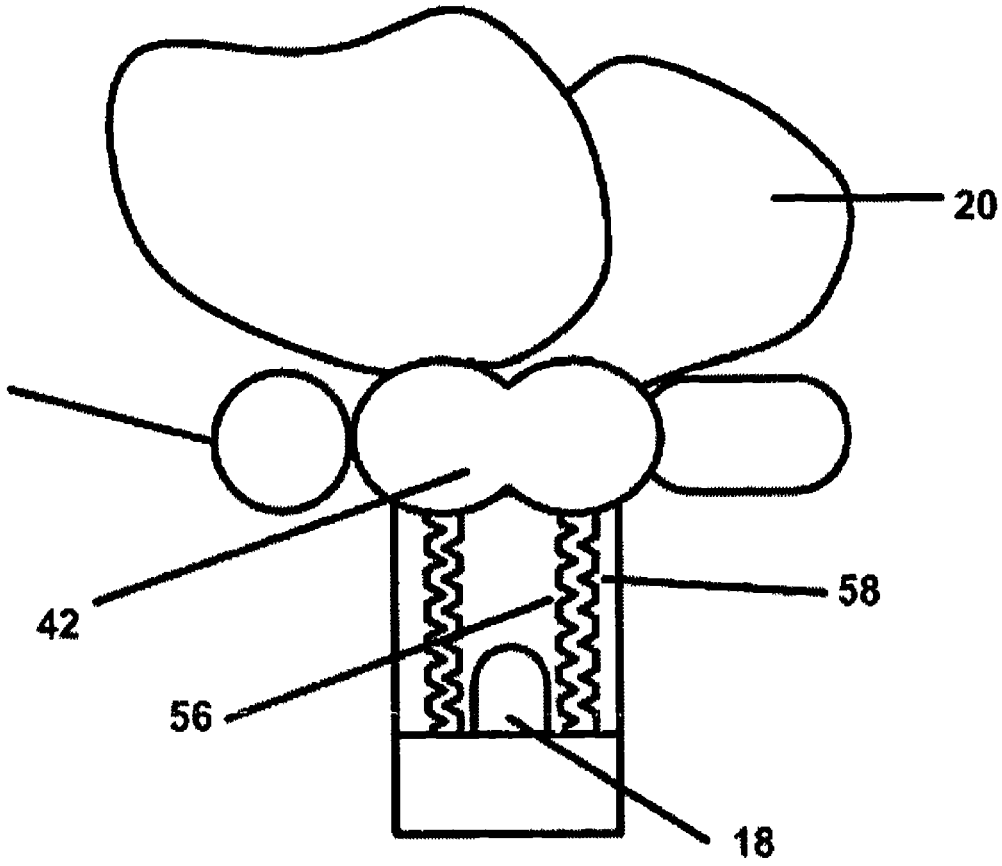
FIG. 9 is a side view of a screw fitting for the light emitting diode and removable ornamental display of the illumination system of FIG. 1.
Figure 10:
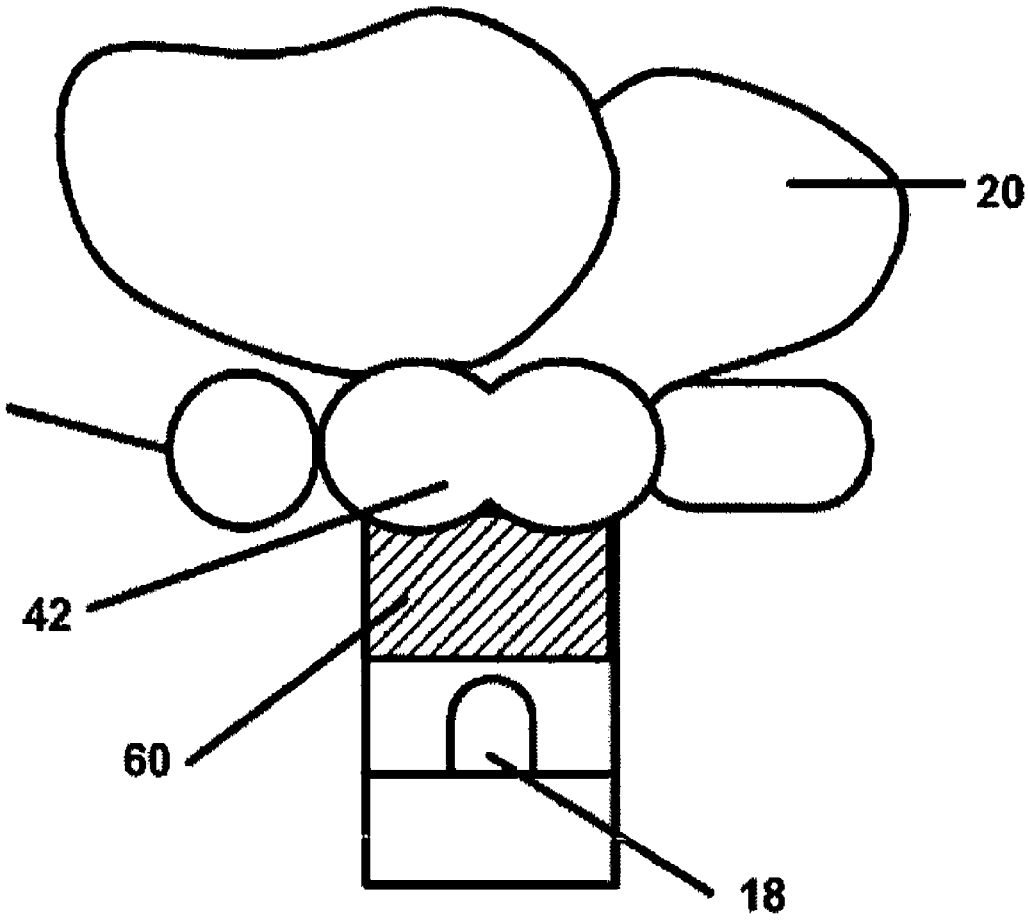
FIG. 10 is a side view of a Velcro attachment for the light emitting diode and removable ornamental display of the illumination system of FIG. 1.

The light emitting diode is removably attached to the ornamental display. The light emitting diode 18 can have a screw fitting 56 in FIG. 9 with the ornamental display 20 having the reciprocal screw fitting 58 so that the LED will screw into the display. The light emitting diode 18 can be removably attached to the ornamental display 20 by a strap 60, a clip or by Velcro in FIG. 10. The light emitting diode can be removably attached to the ornamental display by a plug and socket connector. Plastic ties, wire ties or cable ties are also removable fasteners to attach the LED to the ornamental display.

To position and support the ornamental display, the ornamental display is removed from the light emitting diode.

The bendable electrically conductive wire with the LED at one end is wrapped around a tree or bush branch, a railing, a fence or other object as shown in FIG. 1. The bendable electrically conductive wire is then extended up at the LED end to receive the ornamental display.

The ornamental display is attached back to the LED. The bendable electrically conductive wire supports the weight of the LED illuminated ornamental display. The bendable electrically conductive wire allows the ornamental display to be positioned and oriented in any direction and at any elevation angle. Illuminated displays on a stake are limited to one position and one elevation angle. Here, the ornamental display can be positioned in any orientation, facing a viewer or a window of the house, or the walkway of a house, or a table or a chair or a picture sliding door/window on a balcony or on a porch.

The bendable electrically conductive wire also electrically connects the solar cell and battery to the LED illuminated ornamental display.

Figure 11:
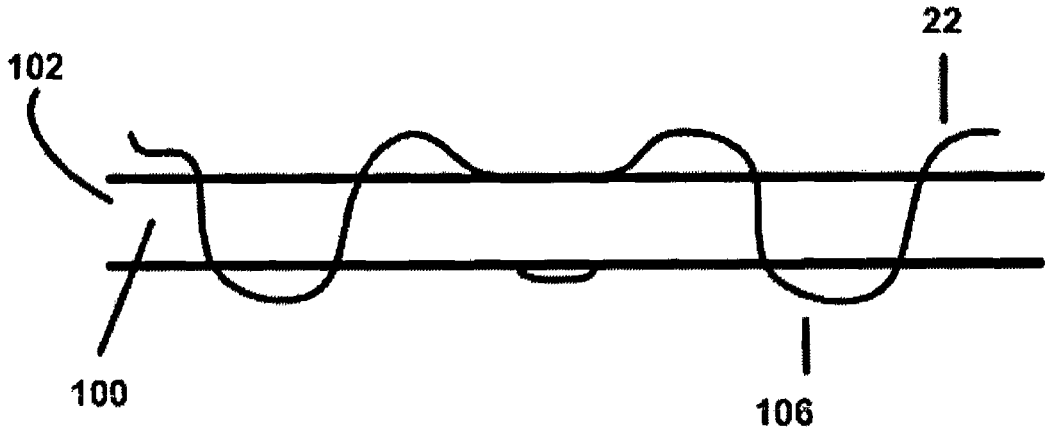
FIG. 11 is a side view of the bendable electrically conductive wire gripping an object of the illumination system of FIG. 1.
Figure 12:
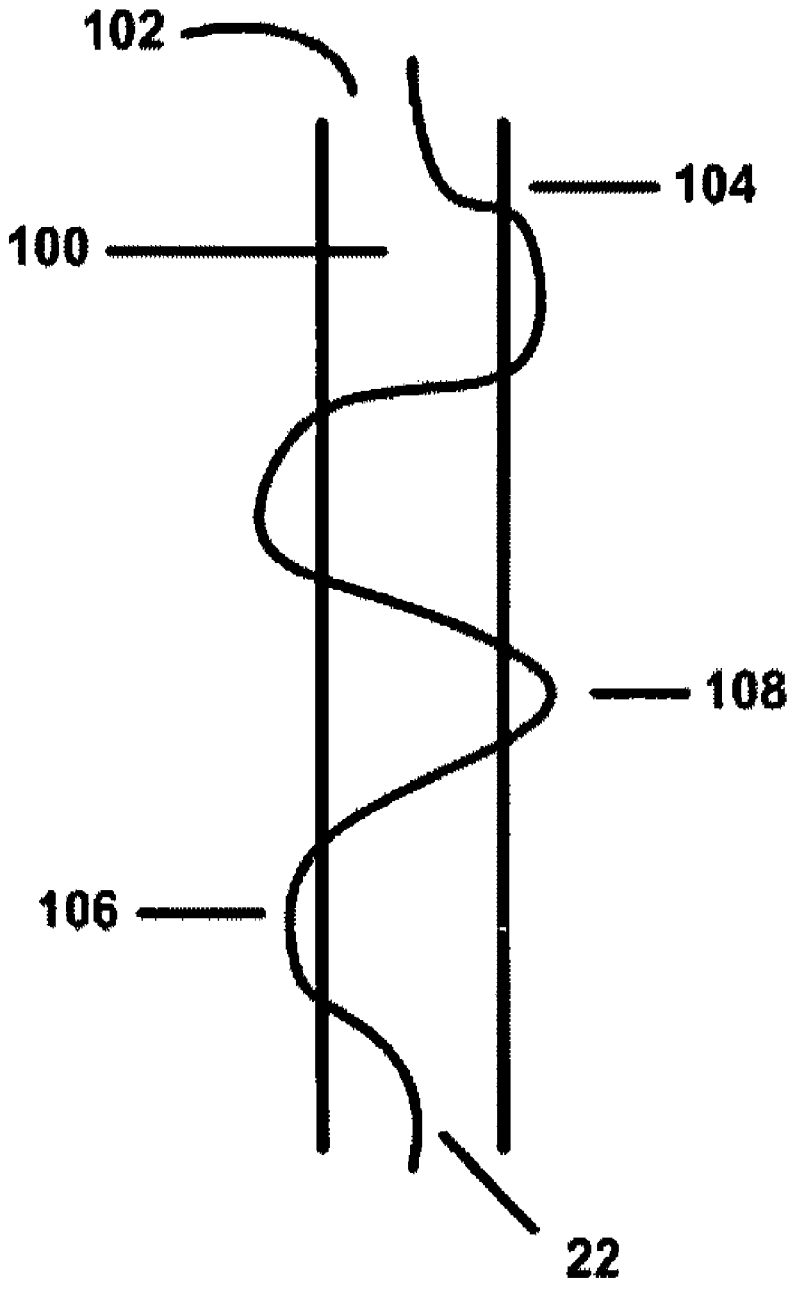
FIG. 12 is a top view of the bendable electrically conductive wire gripping an object of the illumination system of FIG. 10.

Alternately, the bendable electrically conductive wire 22 as shown in FIGS. 11 and 12 can grip the tree or bush branch, the railing, the fence or other object 100, rather than wrap all the way around the object.

The wire 22 will bend down one side 102 of the object 100, then bend back up, bend down the opposite side 104 of the object, then bend back up. The wire will form two U's with one U 106 on the first side and the other U 108 on the opposite second side.

The wire will not completely surround or wrap around the diameter of the object.

The wire will clamp or grip the object.

The ornamental display is attached to the LED. The bendable electrically conductive wire supports the weight of the LED illuminated ornamental display. The bendable electrically conductive wire allows the ornamental display to be positioned and oriented in any direction and at any elevation angle. The ornamental display can have any viewing angle. The bendable electrically conductive wire also electrically connects the solar cell and battery to the LED illuminated ornamental display.

A first ornamental display can be removed from the light emitting diode and then a second different ornamental display can be attached to the light emitting diode.

Also a first light emitting diode (and bendable electrically conductive wire, battery and solar cell) can be removed from an ornamental display and a second different light emitting diode (and bendable electrically conductive wire, battery and solar cell) can be attached to the same ornamental display.

The bendable electrically conductive wire serves two purposes in the present invention.

The bendable electrically conductive wire contains an electrical wire to conduct power from the solar cell and the rechargeable battery to the LED to illuminate the ornamental display. Thus, the bendable electrically conductive wire allows the solar cell to be remote from the LED ornamental display. The solar cell must be in sunlight but the LED ornamental display can be at a different height or position, on a tree or bush branch, along a railing or fence, indoors on a window sill or table, or out of direct sunlight.

The bendable electrically conductive wire also supports the LED ornamental display.

The bendable electrically conductive wire can be bent, twisted, and/or arranged into any position which allows the ornamental display to be arranged and positioned into any desired pattern or arrangement.

Figure 13:
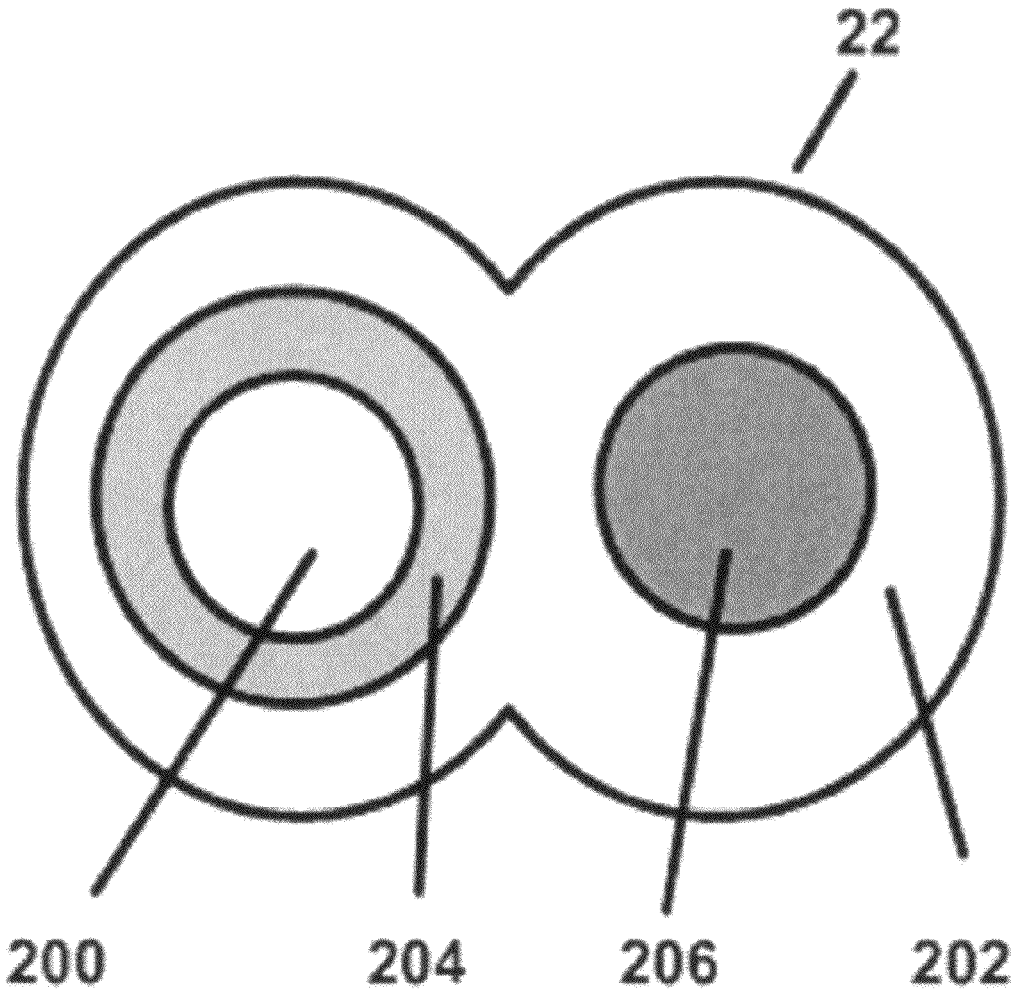
FIG. 13 is a side cross-sectional view of the bendable electrically conductive wire of the illumination system of FIG. 1.

The bendable electrically conductive wire 22 of FIG. 13 has a central electrically conductive wire 200 of copper or another electrically conductive metal surrounded by an insulating cladding layer 204. A flexible wire 206 of metal or plastic or polymer is adjacent to the conductive wire 200 but separated by the insulating cladding layer 204. An electrically insulating sheath 202 of plastic or rubber or another electrically insulating material surrounds the electrically conductive wire 200, the insulating cladding layer 204 and the flexible wire 206. The electrically conductive wire 200 conducts electricity from the battery to the LED. The flexible wire 206 (and the wire 200, cladding layer 204 and insulating sheath 202) physically support the ornamental display.

The metal wire 200 and plastic sheath 202 of the bendable electrically conductive wire 22 are flexible. The bendable electrically conductive wire 22 is sufficiently flexible to be bent or twisted into a position but with enough rigidity to remain in the bent or twisted position until bent or twisted into a new position.

Alternately, the sheath can have additional metal and/plastic layers to be sufficiently flexible to be bent or twisted into a position but with enough rigidity to remain in the bent or twisted position until bent or twisted into a new position.

The bendable electrically conductive wire can also support the solar cell and the rechargeable battery.

The bendable electrically conductive wire can also position the solar cell on the ground, on a branch in a bush or tree, or on a railing or fencing.

Figure 14:
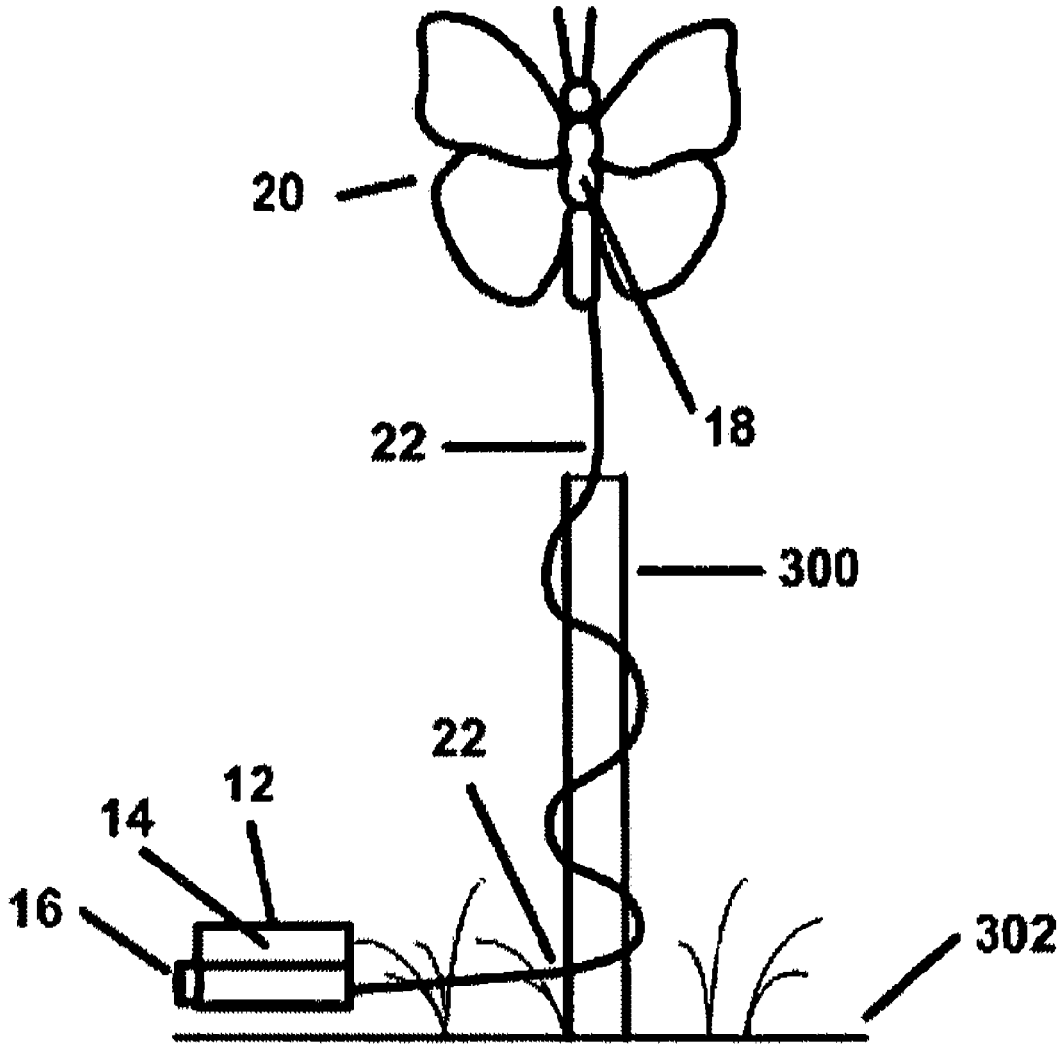
FIG. 14 is a side view of bendable electrically conductive wire wrapped around a stake of the illumination system of FIG. 1.

The bendable electrically conductive wire 22 can be wrapped around a stake or pole 300 as shown in FIG. 14. The ornamental display 20 and LED 18 will be positioned at or adjacent to the top of the stake 300. The solar cell 12 and battery 14 will extend from the stake 300 along the ground 302. The solar cell and battery can be adjacent to the stake or remote, at a distance, from the stake. The ornamental display and LED can also be positioned at the midpoint or lower half of the stake. The positioning of the ornamental display and LED is adjustable along the entire height of the stake or pole.

Figure 15:
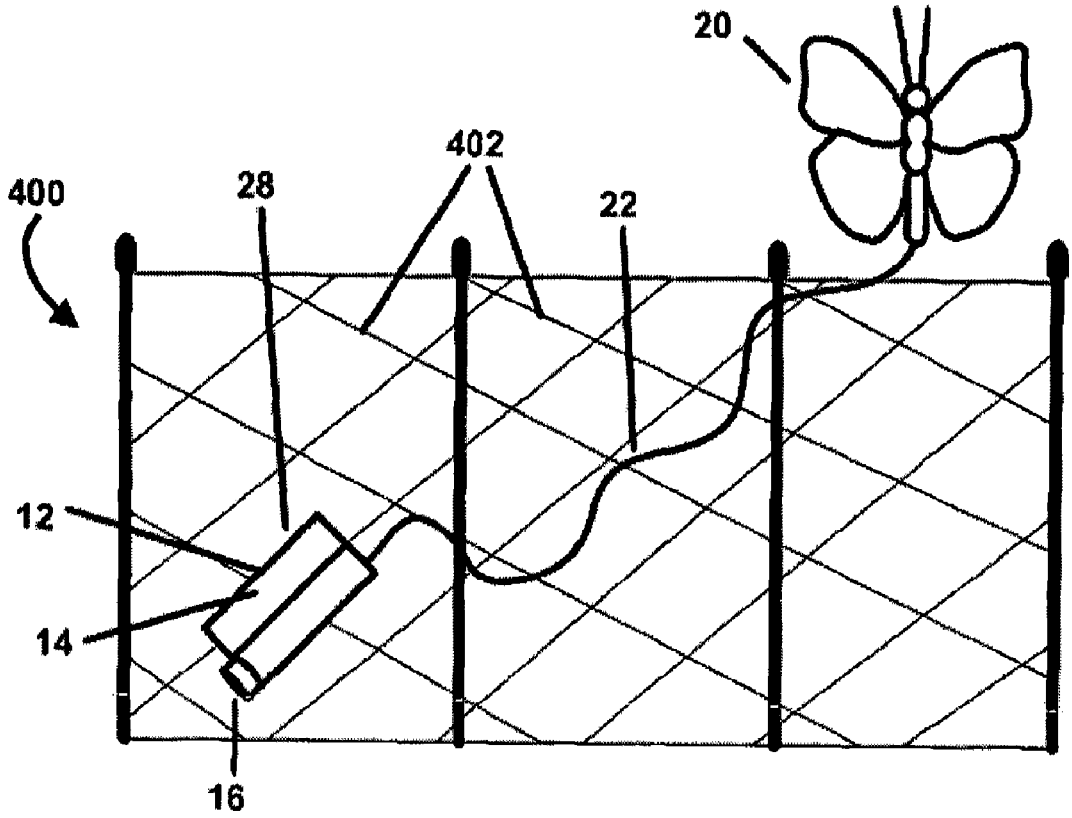
FIG. 15 is a side view of bendable electrically conductive wire intertwined between the links of a fence of the illumination system of FIG. 1.

The light emitting diode ornamental display illumination system 20 is positioned on a chain link fence 400 in FIG. 15.

The ornamental display 20 is removed from the light emitting diode 18 (not shown in this figure).

The bendable electrically conductive wire 22 with the LED at one end is wrapped, gripped, intertwined or interwoven among the chain links 402.

The ornamental display 20 is attached back to the LED 18 (not shown in this figure). The bendable electrically conductive wire 22 among the chain links 402 supports the weight of the LED illuminated ornamental display. The bendable electrically conductive wire 22 allows the ornamental display 20 to be positioned and oriented in any direction and at any elevation angle.

The bendable electrically conductive wire 22 still electrically connects the solar cell 12 and battery 14 to the LED illuminated ornamental display 20. The bendable electrically conductive wire 22 among the chain links 402 supports the weight of the solar cell 12 and the battery 14 in the housing 28. Alternately, the solar cell 12 and the battery 14 in the housing 28 can be positioned on the ground or in the branches of an adjacent bush or adjacent tree or on a stake or pole.

The bendable electrically conductive wire allows the solar cell to be remote from the LED ornamental display. The solar cell must be in sunlight but the LED ornamental display can be at a different height or position on the chain link fence, or even out of direct sunlight.

A first ornamental display can be removed from the light emitting diode and then a second different ornamental display can be attached to the light emitting diode.

Figure 16:
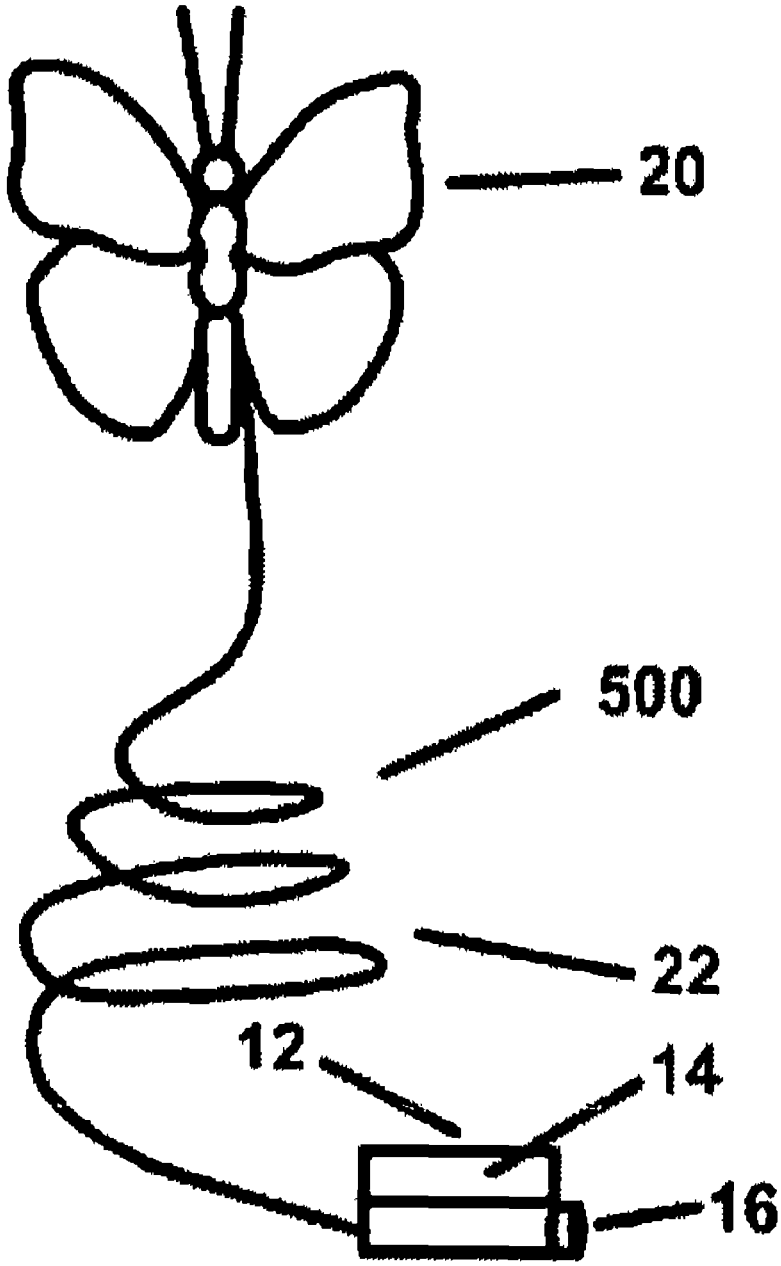
FIG. 16 is a side view of the freestanding base and support of the bendable electrically conductive wire of the illumination system of FIG. 1.

The bendable electrically conductive wire 22 can form a base and support in one structure 500. As shown in FIG. 16, the bendable electrically conductive wire 22 is shaped as concentric circles forming a semispherical shape 500. One open end of the wire extends along the ground to the solar cell 12 and battery 14. The other open end of the wire at the top of the semispherical shape 500 supports the ornamental display 20 (and LED not shown). The unitary base support structure need not be circular in shape, any shape and size of the base support structure that will support the LED and ornamental display while allowing the solar cell at the open end to be in sunlight will be sufficient.

The bendable electrically conductive wire allows the ornamental display to be positioned and oriented in any direction and at any elevation angle on the stake. Prior art illuminated displays on a stake are limited to one position and one elevation angle.

The illumination system of the present invention can be positioned on a balcony or porch. The solar cell can be positioned on a railing or a fence or on an adjacent table. The solar cell needs to be in direct sunlight for at least a portion of the daylight hours. The ornament display can be positioned on a railing or a fence or on an adjacent table.

The illumination system of the present invention can be positioned indoors. The solar cell can be positioned flush to a window, or on a window sill or on a nearby table or counter adjacent to a window. The solar cell needs to be in direct sunlight for at least a portion of the daylight hours.

The solar cell charges a battery during the day so the LED can illuminate and glow the ornamental display at night in a tree or bush, in an outside garden, on a walkway, on a lawn, on an apartment balcony or on a window sill or table indoors.

An ornamental display on a stake limits the ornamental display to a stationary, fixed position near ground level.

A stake cannot be used to position the ornamental display in a bush or tree or on a patio or balcony or indoors.

In an alternate embodiment (not shown), a light sensor can replace the on/off switch. The light sensor will be adjacent to the solar cell and exposed to the ambient light around the solar cell and illumination system.

The light sensor is in the electrical circuit between the battery and the LED. The light sensor will turn the LED on when the ambient light around the sensor is dark.

The light sensor is not positioned near the light emitting diode. The light sensor will not be effected by the light emitted from the LED.

The light sensor will turn the LED off when the ambient light around the sensor is light. The LED will also be turned off, without any action by the sensor, when the battery is drained.

Figure 17:
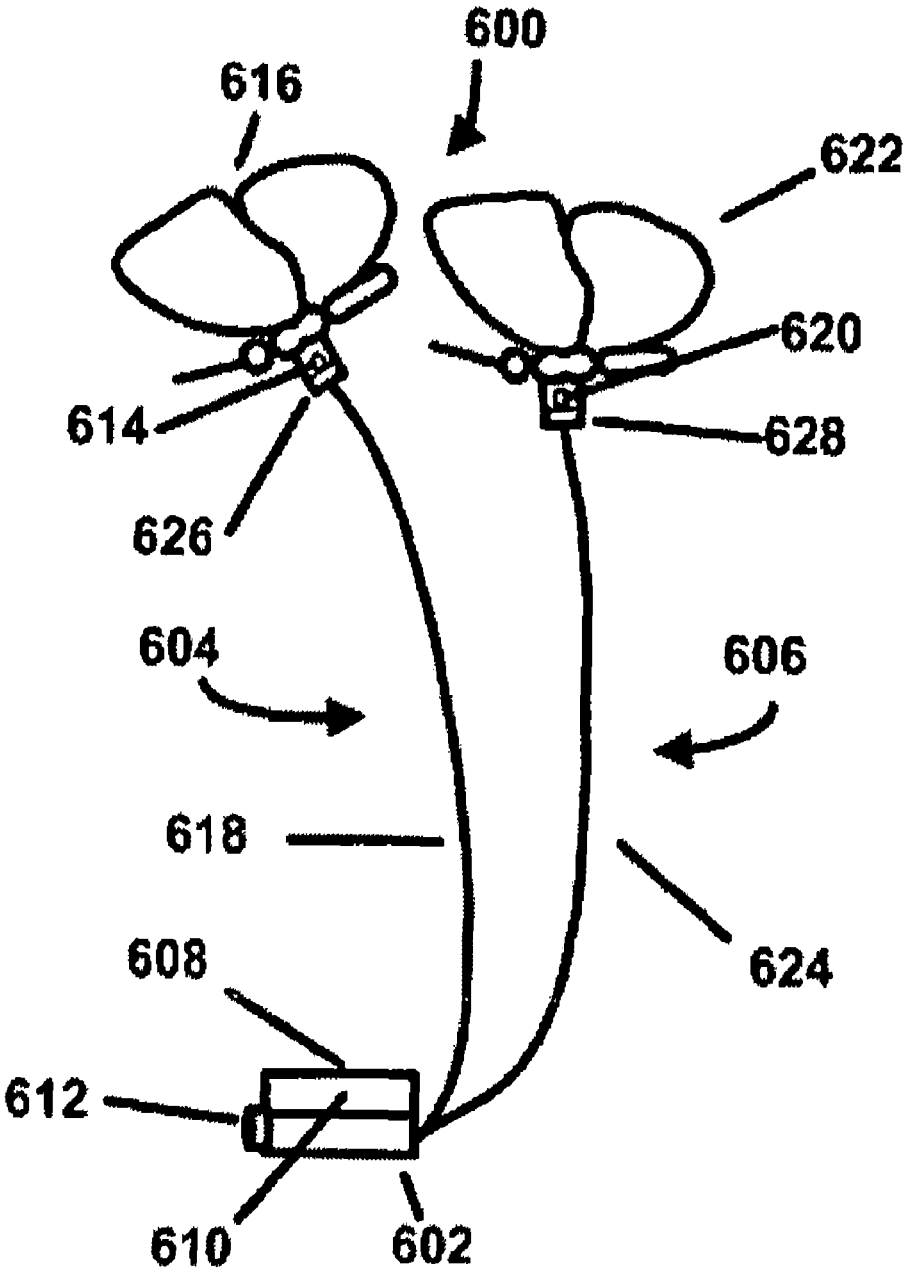
FIG. 17 is a side view of a second embodiment of a light emitting diode (LED) illuminated ornamental display illumination system with a single solar cell power source and two light emitting diode (LED) illuminated ornamental displays.

The light emitting diode (LED) illuminated ornamental display illumination system 600 of FIG. 17 has a single solar cell power source 602 and a first light emitting diode (LED) illuminated ornamental display 604 and a second light emitting diode (LED) illuminated ornamental display 606.

The solar cell 608, the rechargeable battery 610 and the on/off switch 612 of the solar cell power source 602 of FIG. 17 are the same as the solar cell 12 and a rechargeable battery 14 with an on/off switch 16 of FIGS. 1 to 4.

The solar cell 608 of FIG. 17 may have a larger solar cell surface area than the solar cell 12 of FIGS. 1 to 4 to convert more sunlight into more electricity. The rechargeable battery 610 of FIG. 17 may have a more efficient electricity storage capacity or simply a higher storage capacity area than the rechargeable battery 14 of FIGS. 1 to 4. The solar cell 608, the rechargeable battery 610 will be supplying electricity to two light emitting diode (LED) illuminated ornamental displays.

The first light emitting diode (LED) illuminated ornamental display 604 of FIG. 17 has a light emitting diode (LED) 614, an ornamental display 616 which is removably attachable to the LED 614, and a bendable electrical wire 618 which electrically connects the battery 610 to the LED 614 and supports the ornamental display 616. The first light emitting diode (LED) 614, the first ornamental display 616 and the first bendable electrical wire 618 of FIG. 16 are the same as the light emitting diode (LED) 18, the ornamental display 20 and the bendable electrical wire 22 of FIGS. 1 to 5.

The second light emitting diode (LED) illuminated ornamental display 606 of FIG. 17 has a light emitting diode (LED) 620, an ornamental display 622 which is removably attachable to the LED 620, and a bendable electrical wire 624 which electrically connects the battery 610 to the LED 620 and supports the ornamental display 622. The light emitting diode (LED) 620, the ornamental display 622 and the bendable electrical wire 624 of FIG. 17 are the same as the light emitting diode (LED) 18, the ornamental display 20 and the bendable electrical wire 22 of FIGS. 1 to 5.

There are two configurations for the LED control circuit for the light emitting diode (LED) illuminated ornamental display illumination system 600 of FIG. 17 with the single solar cell power source 602 and the two light emitting diode (LED) illuminated ornamental displays 604 and 606.

In the first configuration, a first light emitting diode control circuit 626 is adjacent to the first light emitting diode 614. The LED control circuit 626 is in the electrical circuit between the common battery 610 and the first LED 614. The LED control circuit will control the frequency and intensity of the light emitted from the first LED which illuminates the first ornamental display 616.

A second light emitting diode control circuit 628 is adjacent to the second light emitting diode 620. The LED control circuit 628 is in the electrical circuit between the common battery 610 and the second LED 620. The LED control circuit will control the frequency and intensity of the light emitted from the second LED which illuminates the second ornamental display 622.

The first light emitting diode control circuit 626 is separate and independent from the second light emitting diode control circuit 628. The first light emitting diode (LED) illuminated ornamental display 604 is illuminated separately and independently from the second light emitting diode (LED) illuminated ornamental display 606.

In the second configuration, a single common light emitting diode control circuit can be alternately positioned adjacent to the common solar cell 608 and common battery 610. The LED control circuit is in the electrical circuit between the common battery 610 and the first LED 614 and the common battery 610 and the second LED 620. The single common light emitting diode control circuit will control both LEDs and both ornamental displays. Each LED and display can operate in the same frequency and intensity or with different frequencies and/or different intensities. Each LED and display can have the same or different light patterns.

The two light emitting diode (LED) illuminated ornamental displays with a single solar cell power source of FIG. 17 is merely an illustrative example. The two ornamental displays themselves can be different. Multiple light emitting diode (LED) illuminated ornamental displays can be electrically connected to a single solar cell power source.

The present invention has a transmissive ornamental display. The LED on the bottom surface of the ornamental display transmits light through the ornamental display which is then transmitted out of the top or upper surface of the display. The transmitted light will illuminate or glow the ornamental display for viewing the ornamental display from outside the display.

Figure 18:
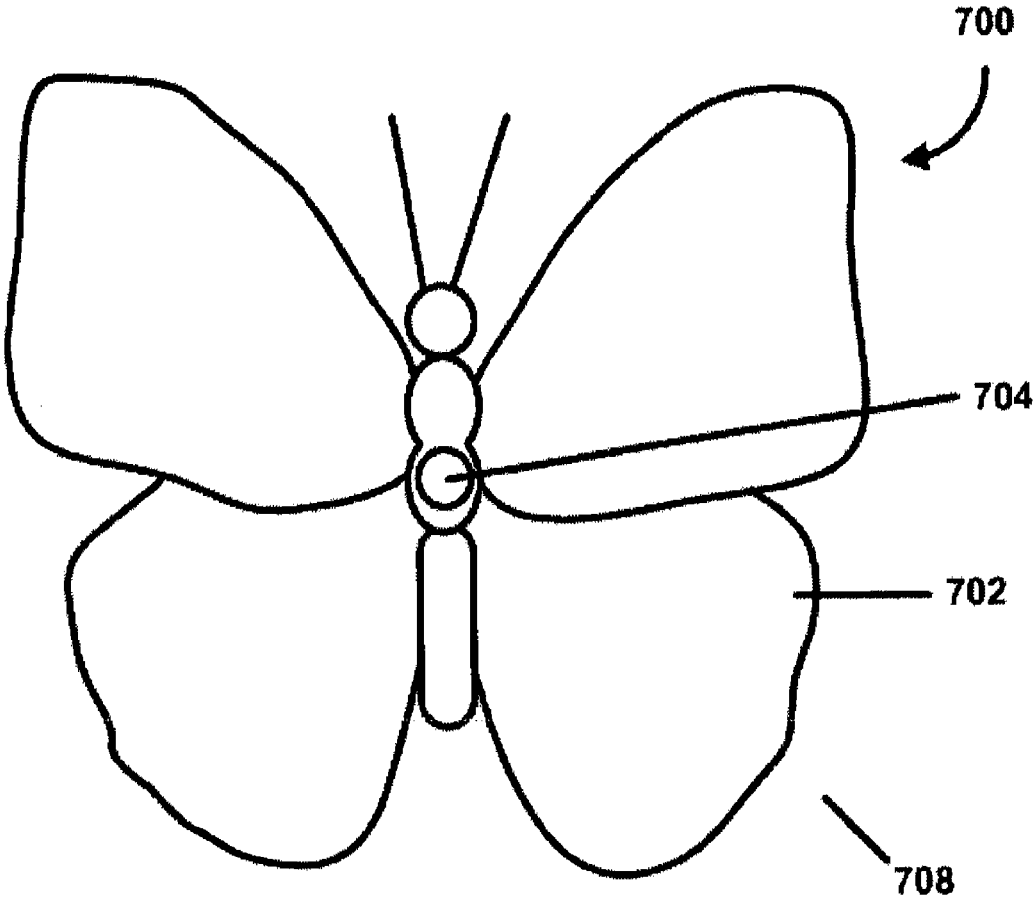
FIG. 18 is a top view of a third embodiment of a light emitting diode (LED) illuminated ornamental display illumination system with a reflective ornamental display.
Figure 19:
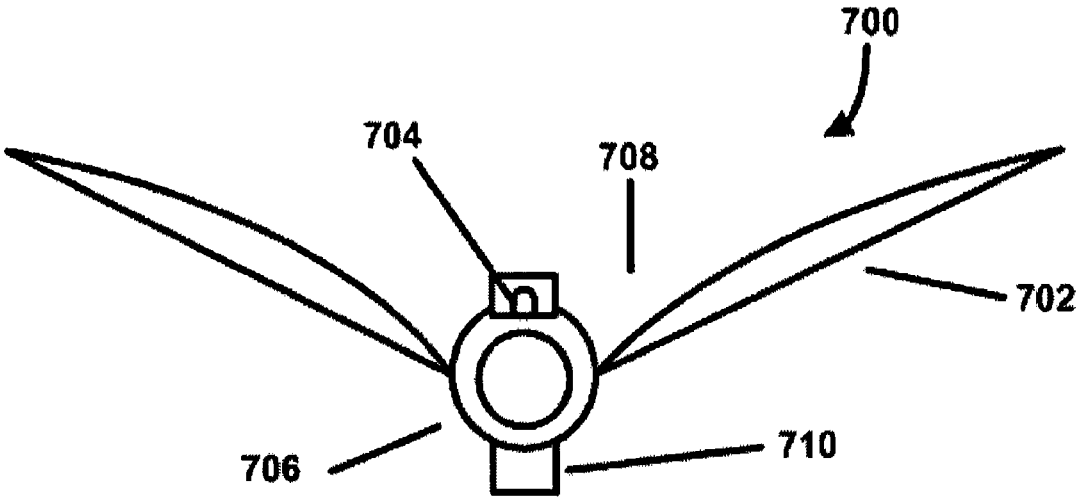
FIG. 19 is a front view of a light emitting diode (LED) illuminated ornamental display illumination system with a reflective ornamental display of FIG. 18.

The light emitting diode ornamental display illumination system 700 of FIG. 18 and FIG. 19 has a reflective ornamental display 702.

The solar cell, the rechargeable battery, the on/off switch, and the bendable electrical wire (not shown in these Figures) of the light emitting diode ornamental display illumination system 700 of FIG. 18 and FIG. 19 are the same as the solar cell 12, the rechargeable battery 14, the on/off switch 16 and the bendable electrical wire 22 of the light emitting diode ornamental display illumination system 10 of FIGS. 1 to 4. The light emitting diode control circuit (not shown) for the ornamental display illumination system 700 of FIG. 18 and FIG. 19 is the same as the light emitting diode control circuit 46 of FIG. 5.

The light emitting diode (LED) 704 of the light emitting diode ornamental display illumination system 700 of FIG. 18 and FIG. 19 is the same as the light emitting diode (LED) 18 of the light emitting diode ornamental display illumination system 10 of FIGS. 1 and 5.

The principal distinctions are the positioning of the LED on the upper surface of the ornamental display and a reflective ornamental display.

The reflective ornamental display has a bottom surface 706 and a top or upper surface 708.

The LED 704 will be removably attached to the upper surface 708 of the reflective ornamental display 702.

The ornamental display 702 can be formed of aluminum or other metals or any other reflective material. The display can be fabricated by conventional casting or molding.

Alternately, a reflective coating can be coated on the upper surface of an ornamental display formed of plastic, polymer, resin, glass, or any other material, including aluminum or other metals. The display can be fabricated by conventional casting or molding, followed by the coating with reflective material.

The light source 704 is removably attached to the upper surface 708 of the reflective ornamental display 702. Light will be emitted by the LED 704. A portion of the light emitted by the LED will directly illuminate the ornamental display. Another portion of the light emitted by the LED will reflect from the upper surface of the reflective ornamental display to illuminate the ornamental display.

The light emitting diode can emit light of a single color such as white, red, blue, green or another color. The light emitting diode can be multiple light emitting diodes emitting light of one color, or two or more colors. The reflective ornamental display or the reflective coating on the upper surface of the ornamental display will reflect light of any color.

The reflective ornamental display or the reflective coating on the upper surface of the ornamental display can be tinted a color, such as red, orange, yellow, green, blue, violet or purple. A white LED will illuminate and glow the ornamental display with the color of the tint of the ornamental display. A colored LED will illuminate and glow the ornamental display with the color combination of the color LED and the color of the tint of the ornamental display material. Portions of the ornamental display can be tinted different colors so the display will illuminate or glow different colors.

The light emitting diode 704 is removably attached to the ornamental display 702 by means previously described in this application.

Figure 20:
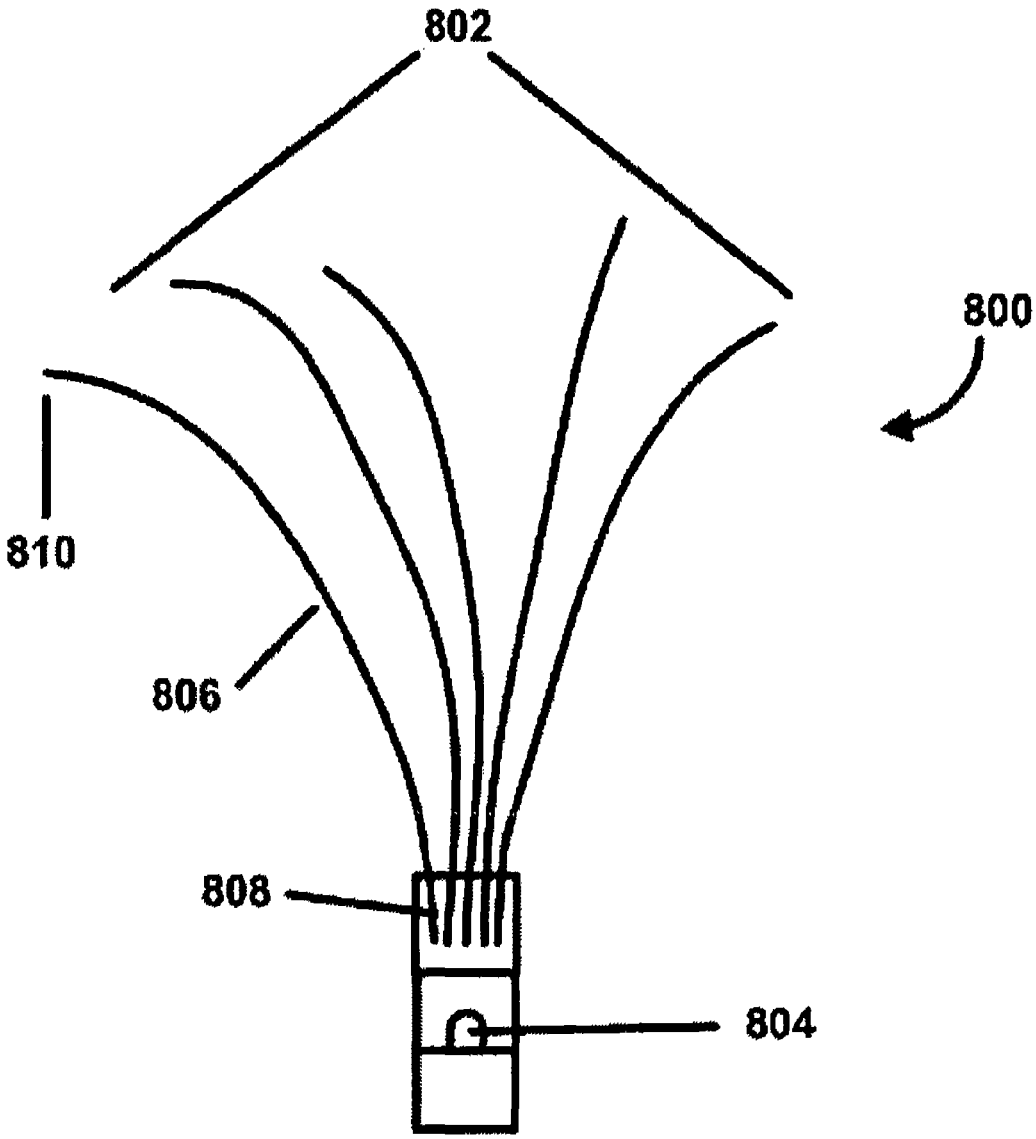
FIG. 20 is a side view of a light emitting diode (LED) illuminated ornamental display illumination system with a plurality of loose optical fibers ornamental display.

The light emitting diode ornamental display illumination system 800 of FIG. 20 has a loose, cascading optical fibers ornamental display 802.

The solar cell, the rechargeable battery, the on/off switch, and the bendable electrical wire of the light emitting diode ornamental display illumination system 800 of FIG. 20 (not shown) are the same as the solar cell 12, the rechargeable battery 14, the on/off switch 16 and the bendable electrical wire 22 of the light emitting diode ornamental display illumination system 20 of FIGS. 1 to 4. The light emitting diode control circuit (not shown) for the ornamental display illumination system 800 of FIG. 20 is the same as the light emitting diode control circuit 46 of FIG. 5.

The light emitting diode (LED) 804 of the light emitting diode ornamental display illumination system 800 of FIG. 20 is the same as the light emitting diode (LED) 18 of the light emitting diode ornamental display illumination system 10 of FIGS. 1 and 5.

The principal distinction is the plurality of loose, cascading optical fibers as the ornamental display.

Each optical fiber 806 in the ornamental display has a first end 808 and an opposing second end 810.

The first ends of each optical fiber are secured in alignment with the LED by adhesive or shrink wrap tubing. The second ends of each optical fiber are not secured and loose. Each second end of the optical fibers has freedom of movement relative to each other second end of the optical fibers.

Light is emitted by the light emitted diode. The LED emitted light will be transmitted through the first end of the optical fiber, along the optical fiber and emitted by the second end of the optical fiber. These open fiber ends emit points of light which illuminate or glow as the ornamental display.

The optical fibers 806 can be the same length or have different lengths.

As an alternate embodiment, the illumination system can operate without the solar cell in use. The rechargeable batteries can be recharged by an alternate, non-solar cell, power source or be replaced by fresh charged regular batteries through the opening in the bottom surface of the housing.

Figure 21:
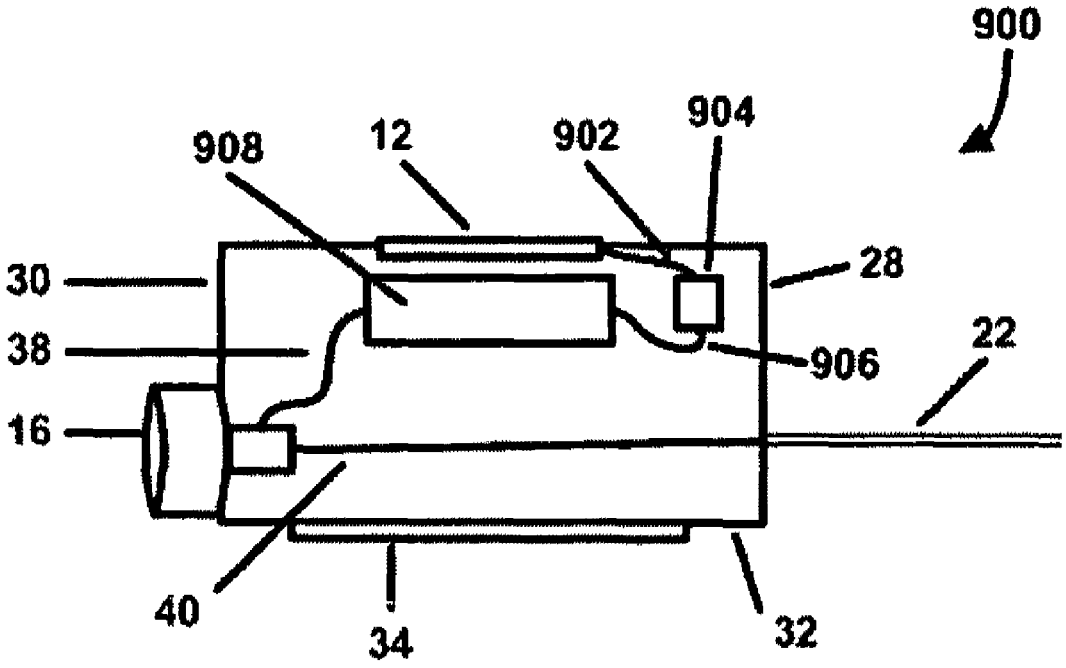
FIG. 21 is a side view of a power source of a solar cell and replaceable battery for the illumination system of FIGS. 1, 2 and 3.

As best seen in the power source 900 of a solar cell and battery of FIG. 21, a wire 902 electrically connects the solar cell 12 to a switch 904. A wire 906 electrically connects the switch 904 to a battery 908. If the battery 908 is a rechargeable battery, then the switch 904 can be on, so that the electricity generated by the solar cell 12 will recharge the battery 908. If the battery is a replaceable battery, then the switch 904 can be off, so that the solar cell does not attempt to recharge a non-rechargeable battery. The replaceable battery can be removed as a charge depleted battery and replaced by a charged battery through the opening 34 in the bottom surface of the housing. The switch 904 will electrically connect the solar cell to a rechargeable battery when the switch is on. The switch 904 will electrically disconnect the solar cell to the rechargeable battery or to a replaceable battery when the switch is off.

A wire 38 electrically connects the battery to the on/off switch 16 and a wire 40 electrically connects the on/off switch to the external bendable electrically conductive wire 22. The wires 38 and 40 and on/off switch 16 will supply power from the battery (whether rechargeable or replaceable) to the LED in the ornamental display for the illumination system.

The illumination system of the present invention is powered by a solar cell with a LED ornamental display which can be used outdoors on a tree branch, in a bush, or on the ground, on a fence or railing of a balcony or porch, or indoors.

The prior art shows a solar cell adjacent to the light display. Therefore, the light display must be in the sunlight like the solar cell and in close proximity to the solar cell. The illumination system of the present invention has a remote solar cell at a distance from the LED ornamental display so the solar cell can be in sunlight while the display is in darkness or at a different height or position from the solar cell.

The prior art devices need a stake or a base. The illumination system of the present invention has a different support means. The bendable electrically conductive wire supplies power from the solar cell to the light emitting diode light source and supports the ornamental display.

The illumination system of the present invention has a detachable, removable, attachable means to change ornamental displays for the LED or to change LEDs for the ornamental display.

The illumination system of the present invention can be positioned by the bendable electrically conductive wire in tree or bush branches, on the ground, on railings and fences, and on windowsills and tables.

The illumination system of the present invention operates outdoors, on porches and balconies, and indoors.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An illumination system comprising an ornamental display;

at least one light emitting diode to illuminate said ornamental display, said ornamental display being removably attached to said at least one light emitting diode;

a rechargeable battery to power said at least one light emitting diode;

a solar cell to charge said rechargeable battery, said solar cell being at a remote distance from said at least one light emitting diode and said ornamental display; and a bendable electrically conductive wire electrically connecting said solar cell and said battery to said at least one light emitting diode; said bendable electrically conductive wire supporting said ornamental display.

2. The illumination system of claim 1 wherein said bendable electrically conductive wire is secured to an object to support said ornamental display.

3. The illumination system of claim 2 wherein said object is a branch, a railing, a fence or the ground.

4. The illumination system of claim 1 wherein said bendable electrically conductive wire is a freestanding base and support for said ornamental display.

5. The illumination system of claim 1 further comprising an on/off switch to turn said at least one diode on to illuminate said ornamental display.

6. The illumination system of claim 1 further comprising a light sensor to turn said at least one diode on to illuminate said ornamental display, when said light sensor is in darkness.

7. The illumination system of claim 1 wherein said ornamental display is formed of plastic.

8. The illumination system of claim 1 wherein said ornamental display is formed of a sheet of optical fibers, said sheet of optical fibers transmitting light from said at least one light emitting diode to the surface of said ornamental display.

9. The illumination system of claim 1 wherein said ornamental display is formed of a plurality of optical fibers, said plurality of optical fibers transmitting light from one end of each optical fibers to another end of each optical fibers.

10. The illumination system of claim 1 wherein said at least one light emitting diode is two light emitting diodes, each light emitting diode emitting light of a different color.

11. The illumination system of claim 1 said at least one light emitting diode is three light emitting diodes, each light emitting diode emitting light of a different color.

12. The illumination system of claim 1 wherein said ornamental display has a bottom surface and an upper surface, further wherein said ornamental display is transmissive, said at least one light emitting diode being positioned on said bottom surface of said ornamental display, said at least one light emitting diode emitting light through said ornamental display and through said upper surface of said ornamental display to illuminate said ornamental display.

13. The illumination system of claim 1 wherein said ornamental display has a bottom surface and an upper surface, further wherein said ornamental display is reflective, said at least one light emitting diode being positioned on said upper surface of said ornamental display, said at least one light emitting diode emitting light from said upper surface, a portion of said light being reflected by said ornamental display, said emitted light and said reflected light to illuminate said ornamental display.

14. The illumination system of claim 1 further comprising a single solar cell;

a single rechargeable battery;

at least two ornamental displays, at least two light emitting diodes, each ornamental display having at least one light emitting diode;

at least two bendable electrically conductive wires; each at least one light emitting diode having at least one bendable electrically conductive wire electrically connecting said solar cell and said battery to said at least one light emitting diode.

15. An illumination system comprising an ornamental display;

at least one light emitting diode to illuminate said ornamental display, said ornamental display being removably attached to said at least one light emitting diode;

a rechargeable battery to power said at least one light emitting diode;

a solar cell to charge said rechargeable battery, said solar cell being at a remote distance from said at least one light emitting diode and said ornamental display; and a bendable electrically conductive wire electrically connecting said solar cell and said battery to said at least one light emitting diode; and said bendable electrically conductive wire secured to an object to support said ornamental display.

16. The illumination system of claim 15 further comprising an on/off switch to turn said at least one diode on to illuminate said ornamental display.

17. The illumination system of claim 15 further comprising a light sensor to turn said at least one diode on to illuminate said ornamental display, when said light sensor is in darkness.

18. An illumination system comprising an ornamental display;

at least one light emitting diode to illuminate said ornamental display, said ornamental display being removably attached to said at least one light emitting diode;

a battery to power said at least one light emitting diode;

a solar cell to charge said battery, said solar cell being at a remote distance from said at least one light emitting diode and said ornamental display, or said battery being replaceable: and a bendable electrically conductive wire electrically connecting said battery to said at least one light emitting diode; said bendable electrically conductive wire supporting said ornamental display.

19. The illumination system of claim 18 further comprising a switch to electrically connect said solar cell to a rechargeable battery when said switch is on and to electrically disconnect said solar cell to said rechargeable battery or to a replaceable battery.

* * * * *